US006681890B1

(12) United States Patent
Chen et al.

(10) Patent No.: US 6,681,890 B1
(45) Date of Patent: Jan. 27, 2004

(54) SOUND BARRIER LAYER FOR INSULATED HEAT SHIELD

(75) Inventors: Colin Ching-Ho Chen, Barrington, IL (US); Mark Boogemans, Belmont (CA); Calin Matias, London (CA)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/007,411

(22) Filed: Nov. 30, 2001

(51) Int. Cl.[7] ..... F01N 7/10

(52) U.S. Cl. ..... 181/291; 165/135; 296/39.3; 702/56; 702/170; 73/579; 73/646; 73/602

(58) Field of Search ..... 181/204, 205, 181/210, 286, 290, 291; 702/54, 56, 137, 170, 171; 324/71.1; 73/579, 646, 602; 165/135, 136; 296/39.3

(56) References Cited

U.S. PATENT DOCUMENTS

| | | | | |
|---|---|---|---|---|
| 3,709,772 A | | 1/1973 | Rice | |
| 3,982,396 A | | 9/1976 | Suzuki | |
| 3,990,856 A | | 11/1976 | Suzuki | |
| 4,069,668 A | | 1/1978 | Oldberg | |
| 5,347,810 A | | 9/1994 | Moore | |
| 5,590,524 A | | 1/1997 | Moore, III et al. | |
| 5,940,788 A | * | 8/1999 | Morman et al. | 702/138 |
| 6,098,579 A | * | 8/2000 | Northam et al. | 123/80 BA |

FOREIGN PATENT DOCUMENTS

JP 0643203 A1 * 3/1995 ..... F01N/7/10

OTHER PUBLICATIONS

Nonlinear Finite Element Analysis of Elastomers, [online], [retrieved Dec. 15, 2002], Retrieved from the MSC Software Web site at <URL:http://www.marc.com/Support/Library/MARC_FEA_ELASTOMERS_2000.pdf> See pp. 25–26.*

* cited by examiner

*Primary Examiner*—Robert E. Nappi
*Assistant Examiner*—David S Warren
(74) *Attorney, Agent, or Firm*—Rader, Fishman & Grauer PLLC

(57) ABSTRACT

An improved heat shield provides thermal insulation and reduced noise transmission of vehicular engine components, including exhaust manifolds. The structure has three layers; an outer structural metal layer, a center insulation layer to isolate heat and dampen noise, and an inner metal layer directly adjacent the shielded component for reflecting heat back to the shielded component. The heat shield is attached by bolts to the shielded component. In the described embodiment, the volume of the insulation layer is expanded by approximately 15 to 20 percent over conventional shields to produce a softer, thicker material having a lower density but unchanged mass. The invention provides a technique to achieve desired thickness and density in insulation layers via modal finite element analysis. The relatively thicker heat shield more effectively absorbs vibration and attenuates noise without increase in mass. In the described embodiment, the layer contains cellulose, diatomaceous earth, talc, and fiberglass.

8 Claims, 3 Drawing Sheets

SOUND BARRIER LAYER FOR INSULATED HEAT SHIELD

BACKGROUND OF THE INVENTION

1. Field of Invention

The present invention relates to protective structures for vehicular engine parts, such as for example engine exhaust manifolds that generate substantial heat and vibration during engine operation. More specifically, the invention relates to the fabrication of protective heat shields applied to such engine parts, and particularly for enhancements of insulation layers employed in such shields for reducing transmission of noise and vibration.

2. Description of the Prior Art

The exhaust manifolds of internal combustion engines in today's modern vehicles can reach under-the-hood temperatures in the neighborhood of 1600 degrees Fahrenheit. Such high temperatures create significant risks of damage to electronic components sharing under-the-hood space with the manifolds. Thus, protection has been provided for such components via use of heat shields designed to at least partially cover up and insulate exhaust manifolds and other heat generating components. In some cases, the shields have been effective to reduce measured temperature levels to within a range of 300 degrees Fahrenheit.

One recurrent shortcoming with respect to current shield designs, however, has been in their inability to reduce or attenuate noise down to satisfactory levels. Generally, the insulation layer is normally the center layer interposed between two metal layers, is relatively thin, and has a relatively high density that is makes it rather stiff. The insulation layer, while often quite adequate to desirably thwart heat transfer at desired values, has been stubbornly insufficient to dampen noise. Unfortunately, the relatively stiff and thin structures for producing heat shields tend to be prone to producing echoes rather than to absorb vibrations and/or noise.

SUMMARY OF THE INVENTION

The present invention provides an improved insulated heat shield for a variety of heat generating components, such as engine exhaust manifolds of internal combustion engines, engine mounts, and catalytic converters of exhaust systems. In one described embodiment, a heat shield is formed as a unitary structure adapted for securement via bolted connection to an engine manifold, and includes three layers; an outer metal layer to provide overall structural integrity, a center layer formed of a relatively thick insulation material of relatively low density to isolate heat and to dampen noise, and an inner metal layer adjacent the shielded component for reflecting heat back to the shielded component.

In the described embodiment, the insulated heat shield includes at least one bolt aperture for attachment of the shield to an under-the-hood shielded component, such as an exhaust manifold; the heat shield is attached by bolts to the shielded component. As disclosed, the volume of the insulation layer is expanded by approximately 15 to 20 percent over conventional insulation materials to produce a softer material having lower density but conventional values of mass. The invention provides that desired values of thickness and density of such layers are determined via modal finite element analysis. The relatively thicker insulation layer of the heat shield is more effective to absorb vibration and to attenuate noise. With no increase in mass, the improved insulation layer is generally no more expensive. In the described embodiment, the insulation layer contains cellulose, diatomaceous earth, talc, and fiberglass.

DETAILED DESCRIPTION OF THE PREFERRED EMBODIMENTS

Figure 1:
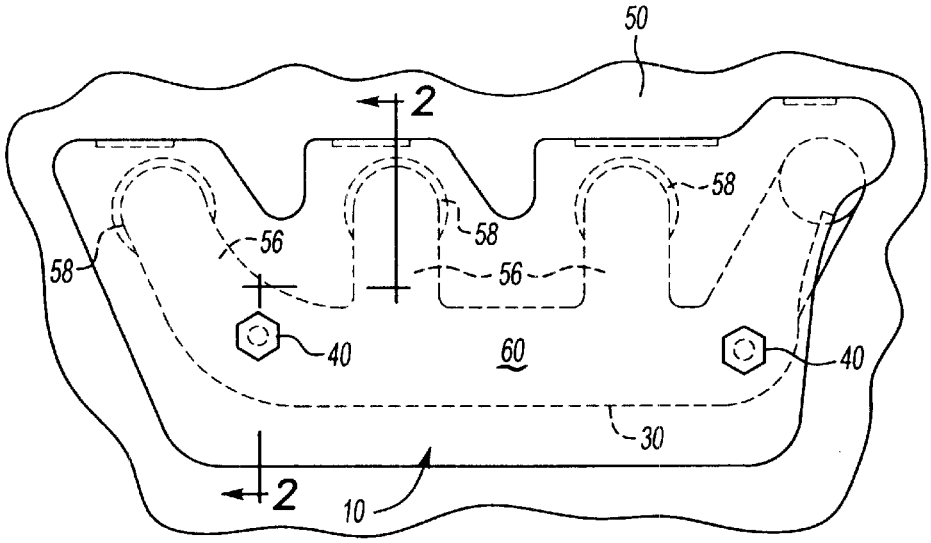
FIG. 1 is a side elevation view of one described embodiment of a heat shield of the present invention installed over an exhaust manifold (shown in phantom) of an internal combustion engine (shown fragmentarily).
Figure 2:
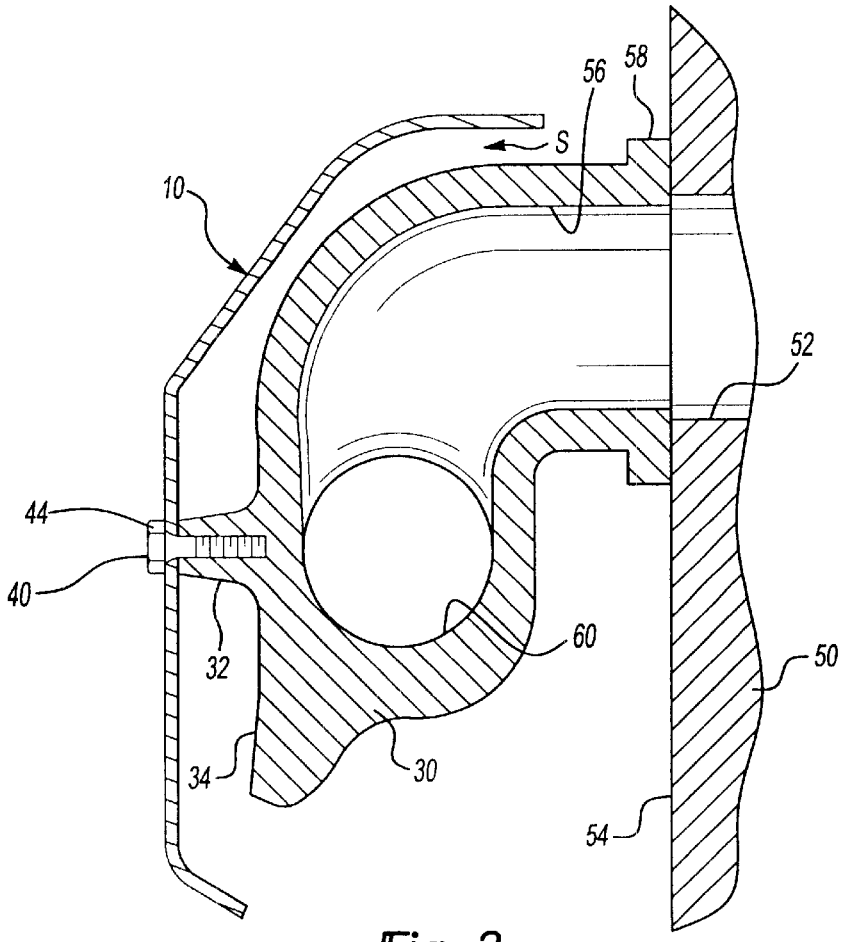
FIG. 2 is a cross-sectional view of the heat shield of FIG. 1 as shown installed over an exhaust manifold in accordance with the present invention, as viewed along lines 2—2 of FIG. 1.

Referring initially to FIGS. 1 and 2, a multi-layered heat shield 10 is adapted to encase or closely surround at least portions of an under-the-hood engine component 30. In the described embodiment, the component 30 (shown in phantom in FIG. 1) is a heavy-duty cast-iron exhaust manifold (30). The manifold 30 is bolted via bolts (not shown) to a plurality of engine exhaust ports 52 on the flank or side 54, of an internal combustion engine 50 (shown fragmentarily). The manifold 30 includes cooperating ports 56 having associated mounting bosses 58 for securement of the manifold 30 to the plurality of engine exhaust ports 52.

The engine exhaust ports 52 operate to collectively receive exhaust gases from individual combustion chambers (not shown) of the engine 50, and to funnel those exhaust gases into a common exhaust pipe portion 60 (FIG. 1) of the manifold 30. An exhaust pipe flange (not shown) is integrally provided at an end of the exhaust pipe portion 60 for securement to a separate exhaust pipe (not shown) to facilitate passage of exhaust gases from the engine 50 to the atmosphere.

Figure 3:
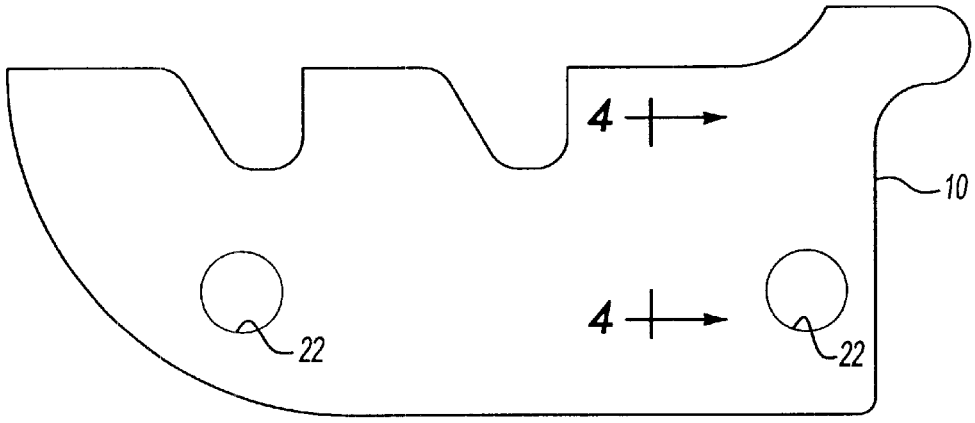
FIG. 3 is an elevation view of the heat shield of FIG. 2, shown detached, and constructed in accordance with the present invention.

A particular aspect of this invention involves control of vibration and noise attenuation properties of the shield 10, particularly as related to the means by which the shield 10 is attached to an engine component, such as the manifold 30. Referring now also to FIG. 3, an enlarged view of the manifold 30 is shown in greater detail. The heat shield 10 is secured to the manifold 30 by bolts 40 that extend through apertures 22 of the shield 10.

For this purpose, the exterior surface 34 of the manifold 30 includes at least two bolt attachment bosses 32 (FIG. 2) that are positioned on and protrude from the exterior surface 34 of the manifold 30. It will further be noted that the heat shield 10 is displaced away from the surface 34 by the bosses 32 to provide an air space S. Those skilled in the art will appreciate that the air space S is effective to impart an insulating effect in addition to that imparted by the actual construction of the heat shield 10.

Those skilled in the art will also appreciate that vibration (and associated noise) are transmitted from the engine 50 into the manifold 30. The vibration then travels from the manifold 30 through the bosses 32 (FIG. 2), and into the heat shield 10. The transmittal of vibration is particularly facilitated by the bolts 40 which have a shank portion (not shown) attached to a bolt head portion 44 (FIG. 2), secured in a manner such as to rigidly retain the shield 10 between the head 44 and the boss 32 as shown.

If not arrested or at least attenuated, those skilled in the art will further appreciate that the vibration will travel through the bosses 32 and bolts 40 and thus into the structure of the shield 10.

Figure 4:
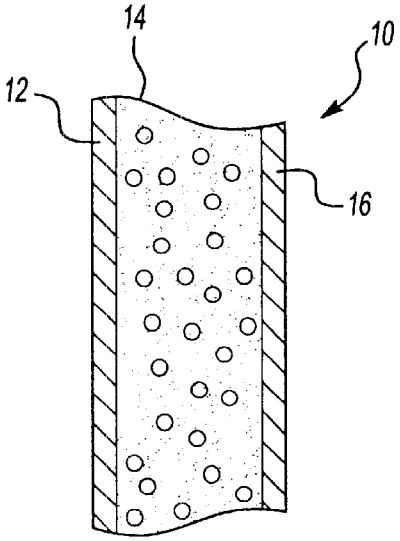
FIG. 4 is a cross-sectional view of a portion of the heat shield of FIG. 3, as viewed along lines 4—4 of FIG. 3.

Referring now also to FIG. 4, the heat shield 10 has a body consisting of three layers; an external or outer metal layer 12 to provide structural integrity and overall rigidity, a center layer 14 of thermal insulation material to isolate temperature and to dampen vibration and noise, and an inner metal layer 16 adjacent the shielded component for reflecting heat back to the shielded component. The respective layers are sandwiched together to form a unitary body as particularly shown in FIG. 3.

The outer metal layer may be preferably formed of cold rolled steel, aluminized steel, aluminum, and even stainless steel for more exotic vehicles where cost is less of a factor. If cold rolled steel is utilized, the exterior of the shield may be coated with a corrosion-resistant material to enhance longevity of the shield.

The inner metal layer 16 is the portion of the shield 10 in closest contact with the exhaust manifold. To the extent that the temperatures of the manifold can reach the 1600 degrees Fahrenheit range, the material of the inner metal layer should be able to withstand significant heat. In some applications the inner layer may be relatively shiny formed of high-temperature alloys, and adapted to reflect heat back to the shielded component. In others, the inner layer 16 can be formed of cheaper materials, including aluminum-clad steel. Those skilled in the art will appreciate choice of materials may be critical for avoiding degradation associated with elevated temperatures and for handling considerable vibrations in particular applications.

Although described with three layers, the shield 10 could be effectively manufactured without the outer layer 12 for some lower budget shields. The inner layer 16 would provide the requisite stiffness and support in such cases, and may need to be relatively thicker in some applications. The material choices for the thermally insulating and vibration and noise dampening center layer 14 are fairly broad. Such choices may include non-metallic fibers such as aramid fibers, or ceramic fiber paper. Depending on anticipated temperature ranges, even non-fiber compositions may be employed, such as densified vermiculite powders, for example.

One method of manufacturing of the heat shield 10 can be described as follows. Each of the inner and outer metal layers 16, 12 are stamped from sheet metal, and formed in a progressive die to the shapes depicted. The insulation layer 14 is then applied against the outer metal layer 12, and the inner metal layer 16 is placed atop the insulation layer.

Ideally, the outer layer 12 will be relatively and slightly oversized compared to inner layer 16, so that edges (not shown) of the layer 12 may be folded over respective mated edges of the inner metal layer, effectively encapsulating the insulation layer 14 between the metal layers 12 and 16.

Figure 5:
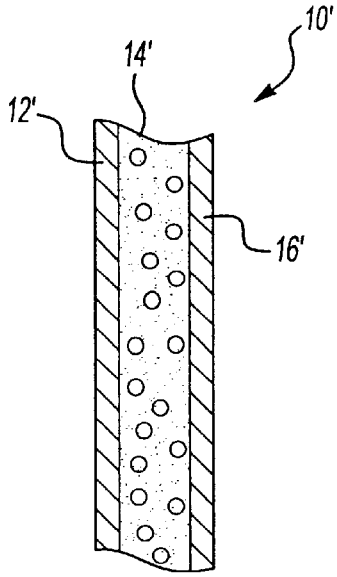
Fig-5 PRIOR ART
FIG. 5 is a similar cross-sectional view of a portion of a relatively thinner prior art heat shield, displayed for comparative discussion purposes, only.

For comparative purposes, a heat shield embodiment 10' of the prior art is depicted in FIG. 5. The heat shield embodiment 10' incorporates an external or outer metal layer 12' to provide structural integrity and overall rigidity, a center layer 14' of thermal insulation material to isolate temperature and to dampen vibration and noise, and an inner metal layer 16' adjacent the shielded component for reflecting heat back to the shielded component, all similar to the heat shield 10. However, it will be appreciated that the insulation layer 14' is noticeably thinner, although having the same mass as the insulation layer 14, because the insulation layer 10' has not been expanded in accordance with the apparatus and method of the present invention.

Desired values of thickness and density of the insulation layer 10' are determined via modal finite element analysis, a technique described herein that permits a simple trial and error approach to manufacturing what will generally be a relatively thicker insulation layer of the heat shield, and one more effective to absorb vibration and to attenuate noise. The resulting shield with the improved insulation layer will be without any increase in mass, and thus will produce no weight penalty. As such, the shield will generally be no more expensive than prior art heat shields.

EXAMPLE

One method of manufacturing a heat shield for an under-the-hood vehicular engine component produces a shield of three layers, including an inner metal layer, an outer metal layer, and a non-metallic insulation layer sandwiched therebetween. The inner metal layer adapted to be positioned directly adjacent or proximal the engine component, and the insulation layer is positioned radially outwardly of the inner metal layer. The layers collectively provide thermal insulation of, and reduced noise transmission from, the engine component. The specific method included the following steps:

a) establishing relative thickness and density values of an insulation layer by using non-linear modal finite element analysis. (For this step, the heat shield is attached to a test component via fastening bolts. The shield is vibrationally excited to measure and map relative amplitudes of vibration over the entire body of the shield.)

b) determining optimal values of the insulation layer thickness and density at a primary critical frequency of the shield as required to optimize level of reduced noise transmission when parameters of size and shape of the shield, and fastening bolt locations of the shield, are fixed.

Given that the parameters of shape of the shield 10, thickness of the shield metal layers 12 and 16, and location of bolts holes are fixed, the thickness of the insulation becomes the primary undetermined variable.

Establishing an operating requirements frequency is an initial objective. This involves identifying and isolating the critical frequency, i.e. the frequency that produces the greatest amounts of vibration over the body of the shield. Several tools are available to aid in this function. For example, Abaqus software manufactured by Hibbett, Karlsson, and Sorensen, of Pawtucket, R.I., was employed to map various levels of vibration produced by excitation of the body of the shield.

Figure 6:
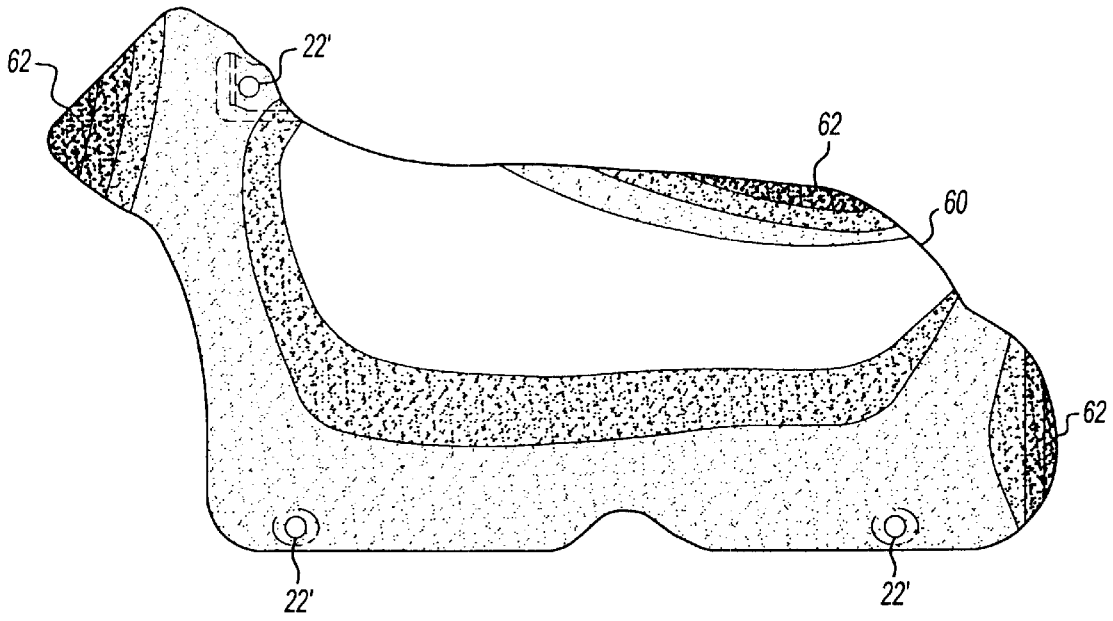
FIG. 6 is an elevation view of another embodiment of a shield, showing various degrees of shading in various areas of the body of the shield to reflect data generated during a modal finite element analysis of the shield.

Referring now to FIG. 6, another embodiment of the heat shield 60 is shown under such vibratory conditions. The darkest regions 62 represent areas of the shield 60 undergoing most significant or greatest vibration generated at the particular excitation frequency. The intermediately grayed regions 64 represent areas of lesser vibration and lighter regions 66 even less vibration, etc.

The areas of vibration are less critical the lighter shaded they are. Thus, ideally the particular thickness of the insulation layer 14 should be increased to the point where there are virtually no areas 62, if possible. In the example presented, after five iterations, and after starting with an insulation layer 14 having a test thickness of 0.9 mm, a heat shield 60 had no areas 62 after the test insulation thickness was increased by 20 percent. Thus, the final thickness of the insulation layer 14 in the example presented was 1.08 mm. The test thickness was based upon a given range of engine operating frequencies, a specific shape of the shield, and the specific location of bolts holes 22'.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A method of manufacturing a heat shield for an under-the-hood vehicular engine component, said shield comprising at least two layers, including an inner metal layer and a non-metallic insulation layer; the metal layer adapted to be positioned directly proximal to said engine component, said insulation layer positioned outwardly of said metal layer relative to said component, said layers collectively providing thermal insulation of, and reduced noise transmission from, said component; said method comprising:

attaching a heat shield to a test component;

vibrationally exciting said heat shield;

measuring relative amplitudes of vibration over substantially the entire body of said heat shield; and establishing relative thickness and density values of said insulation layer by non-linear modal finite element analysis.

2. The method of claim 1, comprising an additional step of determining an optimal thickness for said inner metal layer and an optimal density value of said insulation layer at a primary critical frequency.

3. The method of claim 2, wherein said inner metal layer has a predetermined thickness as part of the non-linear modal finite element analysis.

4. The method of claim 2, wherein said insulation layer has a predetermined density value as part of the non-linear modal finite element analysis.

5. The method of claim 1, wherein said optimal thickness of said inner metal layer effectively reduces transmittal of vibration and noise substantially throughout said heat shield.

6. A heat shield for an under-the-hood vehicular engine component comprising three layers; an outer metal layer, an insulation layer, and an inner metal layer selectively positioned proximal to a shielded component; said insulation layer positioned intermediately between said metal layers, said layers collectively providing thermal insulation of, and reduced noise transmission from, said component, said heat shield comprising at least one bolt aperture to facilitate attachment of said shield to said shielded component, wherein said thickness and density of said insulation layer of said heat shield is established by modal finite element analysis by attaching said shield to a test component and vibrationally exciting said shield to measure and map relative amplitudes of vibration over substantially the entire body of said shield and determining optimal values of said insulation layer thickness and density at a primary critical frequency.

7. The heat shield of claim 6, wherein said component comprises an exhaust manifold fixed to an engine, selectively carrying hot engine gases away from said engine.

8. The heat shield of claim 6, wherein said inner metal layer adjacent to said shielded component selectively reflects heat back to the shielded component.

* * * * *